US009630121B1

(12) United States Patent
Bridgewater

(10) Patent No.: US 9,630,121 B1
(45) Date of Patent: Apr. 25, 2017

(54) MODULAR FLYING DISC

(71) Applicant: Marcus Bridgewater, Sugarland, TX (US)

(72) Inventor: Marcus Bridgewater, Sugarland, TX (US)

( * ) Notice: Subject to any disclaimer, the term of this patent is extended or adjusted under 35 U.S.C. 154(b) by 0 days.

(21) Appl. No.: 14/715,741

(22) Filed: May 19, 2015

(51) Int. Cl.
*A63H 33/18* (2006.01)

(52) U.S. Cl.
CPC ..... *A63H 33/18* (2013.01)

(58) Field of Classification Search
CPC ..... A63H 33/18; A63H 33/22
See application file for complete search history.

(56) References Cited

U.S. PATENT DOCUMENTS 3,948,523 A 4/1976 Michael
4,115,946 A * 9/1978 Vukmirovich ..... A63H 33/18 16/DIG. 8
4,173,839 A * 11/1979 Kovac ..... A63H 33/18 446/46
4,201,009 A * 5/1980 Burridge, Jr. ..... A42B 1/006 2/175.1
5,118,318 A * 6/1992 Lorizio ..... A47G 9/0253 428/100
5,123,869 A * 6/1992 Schipmann ..... A63H 33/18 446/225
5,261,846 A 11/1993 Hanna
5,326,299 A * 7/1994 Jasinski ..... A63H 33/18 446/46
5,358,440 A * 10/1994 Zheng ..... A63H 33/18 446/46
5,655,777 A * 8/1997 Neading ..... A63H 33/18 473/594
5,706,756 A 1/1998 Cunningham
6,174,214 B1 1/2001 Cooper
6,390,879 B1 * 5/2002 Spector ..... A63H 33/18 446/369
6,565,404 B2 * 5/2003 Oblack ..... A63H 33/18 446/46
D686,374 S 7/2013 Nazimek
2007/0077851 A1 * 4/2007 Gilbert ..... A63H 33/18 446/46
2009/0247041 A1 * 10/2009 Cowles ..... A63H 33/22 446/46
2010/0048087 A1 * 2/2010 McCabe ..... A63H 3/005 446/73
2014/0045402 A1 2/2014 Miller
2014/0065919 A1 * 3/2014 Oblack ..... A63H 33/18 446/46

FOREIGN PATENT DOCUMENTS

CA 1207813 7/1986

* cited by examiner

*Primary Examiner* — Aarti B Berdichevsky
*Assistant Examiner* — Urszula M Cegielnik

(57) ABSTRACT

The modular flying disc is an amusement device that is aerodynamically supported. The modular flying disc is a flying device that has four weighted corner sections and a center weighted section that allow the modular flying disc to expand with centrifugal force when thrown. In various embodiments of the disclosure, the weights used in the four weighted corner sections are configured to allow multiple modular flying discs to be stacked. The modular flying disc comprises a swatch, a center weight, and a plurality of corner weights.

1 Claim, 6 Drawing Sheets

MODULAR FLYING DISC

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of aerodynamically supported amusement devices, more specifically, a toy configured as a spinning disc.

SUMMARY OF INVENTION

The modular flying disc is an amusement device that is aerodynamically supported. The modular flying disc is a flying device that has four weighted corner sections and a center weighted section that allow the modular flying disc to expand with centrifugal force when thrown. In various embodiments of the disclosure, the weights used in the four weighted corner sections are configured to allow multiple modular flying discs to be stacked.

These together with additional objects, features and advantages of the modular flying disc will be readily apparent to those of ordinary skill in the art upon reading the following detailed description of the presently preferred, but nonetheless illustrative, embodiments when taken in conjunction with the accompanying drawings.

In this respect, before explaining the current embodiments of the modular flying disc in detail, it is to be understood that the modular flying disc is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the modular flying disc.

It is therefore important that the claims be regarded as including such equivalent construction insofar as they do not depart from the spirit and scope of the modular flying disc. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
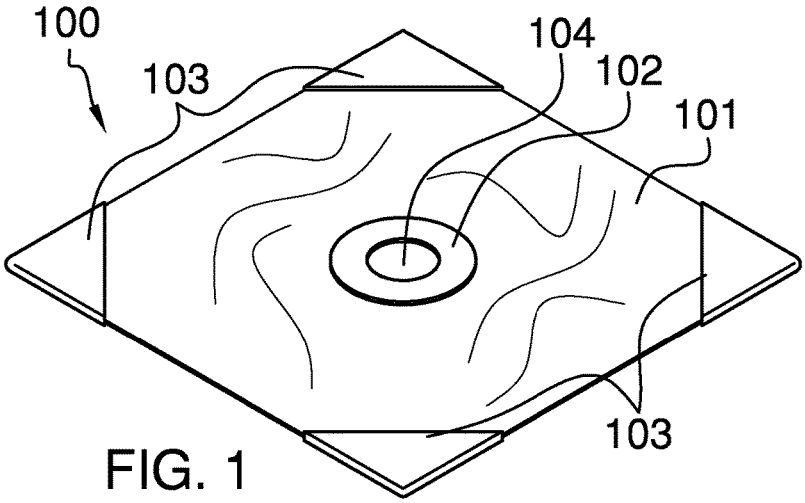
FIG. 1 is a perspective view of an embodiment of the disclosure.
Figure 2:
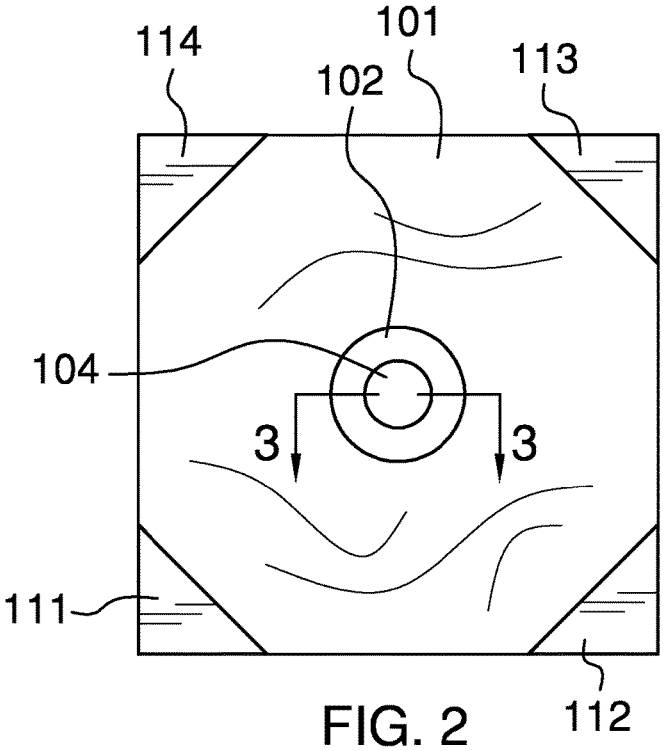
FIG. 2 is a top view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to several potential embodiments of the disclosure, which are illustrated in FIGS. 1 through 9. The modular flying disc 100 (hereinafter invention) comprises a swatch 101, a center weight 102, and a plurality of corner weights 103.

The center weight 102 comprises a ninth ring 149 and a tenth ring 150. The ninth ring 149 and the tenth ring 150 are circular metal discs with a circular open space 104. The circular open space 104 of the ninth ring 149 is centered on the same center point as the ninth ring 149. The circular open space 104 of the tenth ring 150 is centered on the same center point as the tenth ring 150. The outer diameters 142 of the ninth ring 149 and the tenth ring 150 are identical. The inner diameters 143 of the ninth ring 149 and the tenth ring 150 are identical. The ninth ring 149 and the tenth ring 150 are positioned so that a line drawn from the center of the ninth ring 149 and the center of the tenth ring 150 runs through the center of the swatch 101 in a manner perpendicular to the swatch 101. By perpendicular to the swatch 101 is meant that the perpendicular to the twenty first side 161 of the swatch and perpendicular to the twenty second side 162 of the swatch 101. (The swatch 101 is discussed later in this disclosure).

The center point of the swatch 101 is the center of rotation of the invention 100. The line between the center of the ninth ring 149 and the center of the tenth ring 150 forms an axis which is perpendicular to the plane of the swatch 101. The rotation of the invention 100 rotates around this axis.

Figure 6:
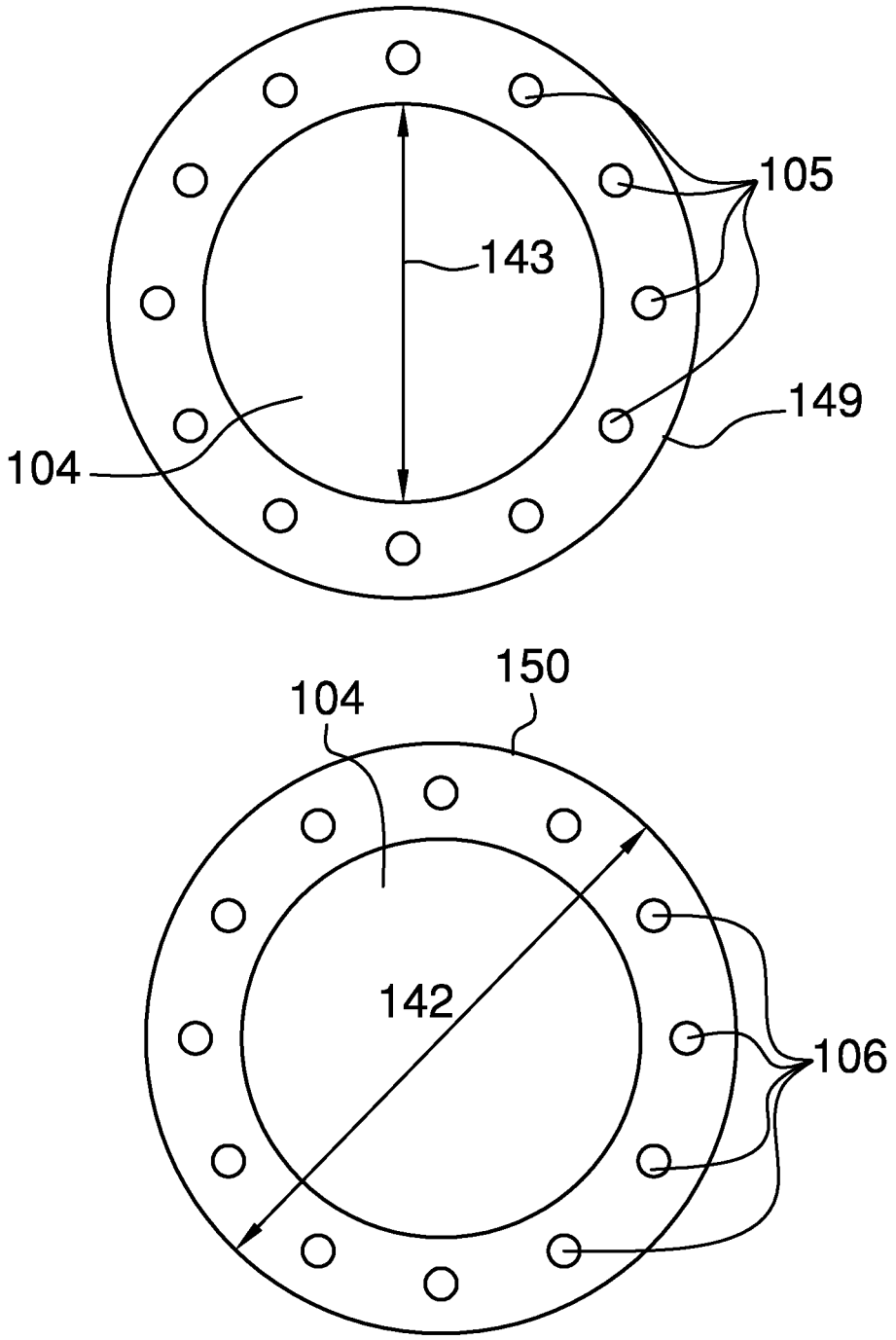
FIG. 6 is a detail view of an alternate embodiment of the disclosure.

There are several ways to attach the center weight 102 to the swatch 101. The swatch 101 is further defined by a twenty first side 161 and a twenty second side 162. In a first potential embodiment of the disclosure, as shown in FIG. 6, a ninth plurality of holes 105 are formed through the surfaces of the ninth ring 149 and tenth plurality of holes 106 are formed through the surfaces of the tenth ring 150. The ninth ring 149 is positioned so that the center of the ninth ring 149 is positioned over the center of twenty first side 161 of the swatch 101. The tenth ring 150 is positioned over the center of twenty second side 162 of the swatch 101 so that the tenth plurality of holes 106 are aligned with the ninth plurality of holes 105. The tenth ring 150 can then be joined to the swatch 101 and the ninth ring 149 by sewing. In the second potential embodiment of the disclosure, the ninth ring 149 and the tenth ring 150 are formed using magnetized metals.

Figure 3:
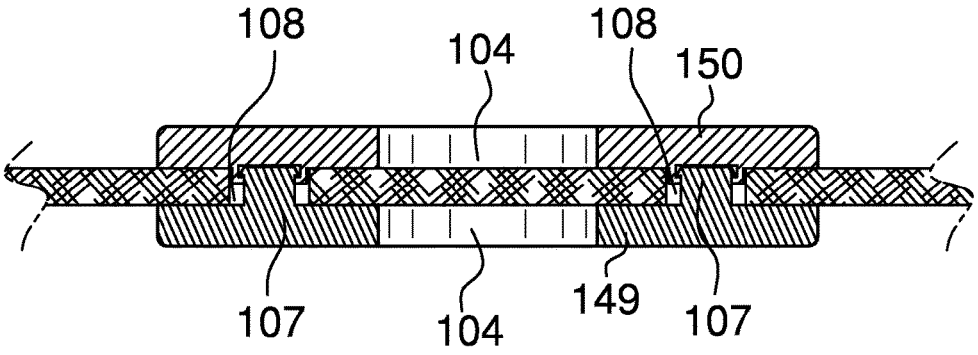
FIG. 3 is a cross-sectional view of an embodiment of the disclosure.
Figure 4:
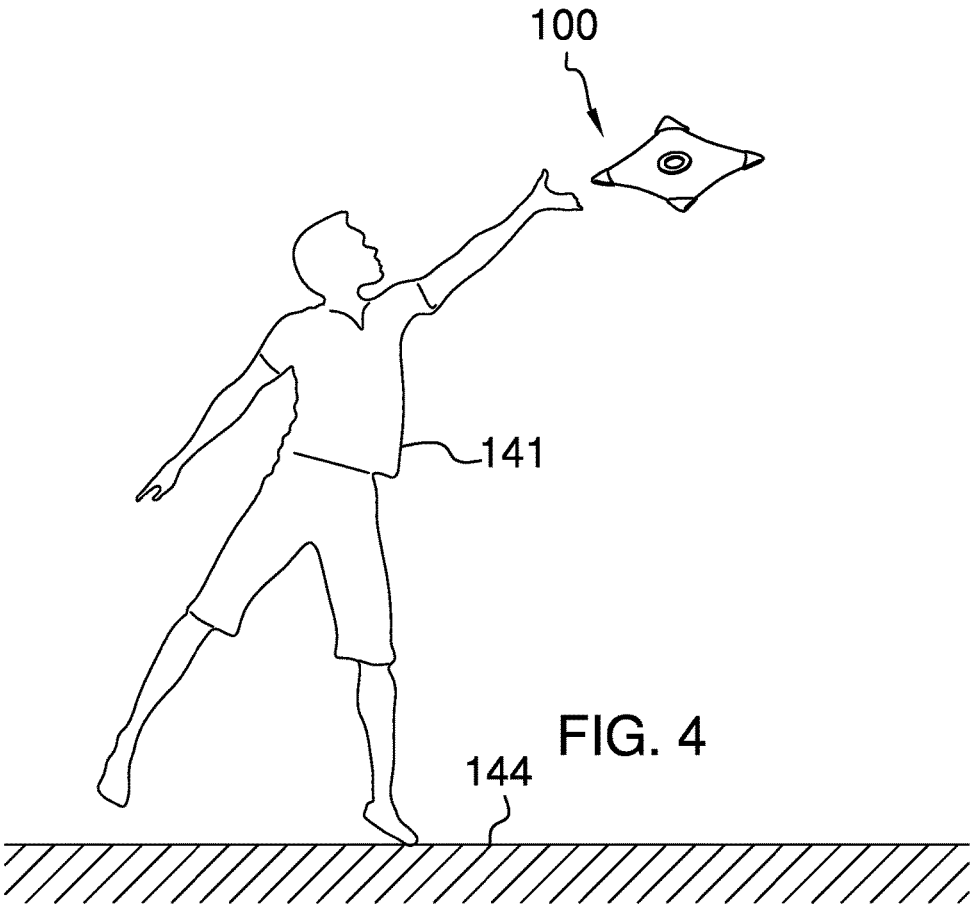
FIG. 4 is an in use view of an embodiment of the disclosure.
Figure 5:
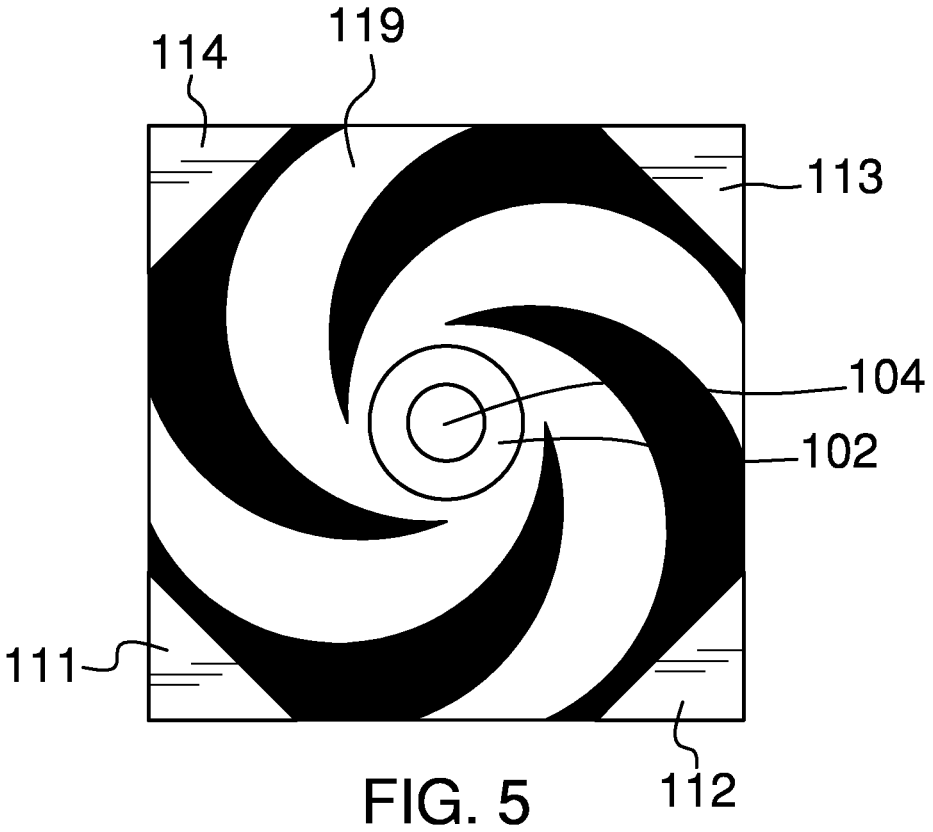
FIG. 5 is a top view of an alternate embodiment of the disclosure.

In this embodiment, the ninth ring 149 is positioned so that the center of the ninth ring 149 is positioned over the center of twenty first side 161 of the swatch 101 and the tenth ring 150 is positioned over the center of twenty second side 162 of the swatch 101. The magnetic attraction between the ninth ring 149 and the tenth ring 150 will secure the center weight 102 to the swatch 101. In a third potential embodiment of the disclosure, the ninth ring 149 and the tenth ring 150 can be attached using a snap device. In this embodiment, the ninth ring 149 is formed with a plurality of snap posts 107 and the tenth ring 150 is formed with a plurality of snap holes 108. As shown in FIG. 3, the swatch 101 can be fitted with grommets aligned to allow the each of the plurality of snap posts 107 to access each of the plurality of snap holes 108. Alternatively, the swatch 101 can be secured simply by using each of the plurality of snap posts 107 to push fabric from the swatch 101 into the plurality of snap holes 108. More specifically, the center weight 102 is attached to the swatch 101 using the plurality of snap posts 107 and the plurality of snap holes 108. The plurality of snap posts 107 may be defined as a first plurality of snaps; whereas the plurality of snap holes 108 may be further defined as a second plurality of snap holes. Each of the plurality of corner weights 103 is attached to the swatch 101 using the plurality of snap posts 107 and the plurality of snap holes 108. The plurality of snap posts 107 may be further as a third plurality of snaps; whereas the plurality of snap holes 108 may be further defined as a fourth plurality of snap holes.

Each of the plurality of corner weights 103 is attached to a corner of the swatch 101. Each of the plurality of corner weights 103 is a triangular structure formed in the shape of a right isosceles triangle. Each of the plurality of corner weights 103 comprises an eleventh mass 151 and a twelfth mass 152. The eleventh mass 151 and the twelfth mass 152 are each formed in the shape of a right isosceles triangle of the same size.

The purpose of the each of the plurality of corner weights 103 is to add mass to the corners of the swatch 101. When the invention 100 is rotating and the center of rotation is the center of the swatch 101, the each of the plurality of corner weights 103 undergoes centrifugal action which is counteracted by a centripetal force in the form of tension placed on the swatch 101. If the swatch 101 is built with elasticity, this centripetal force will cause the span of the swatch 101 to increase when thrown.

Figure 7:
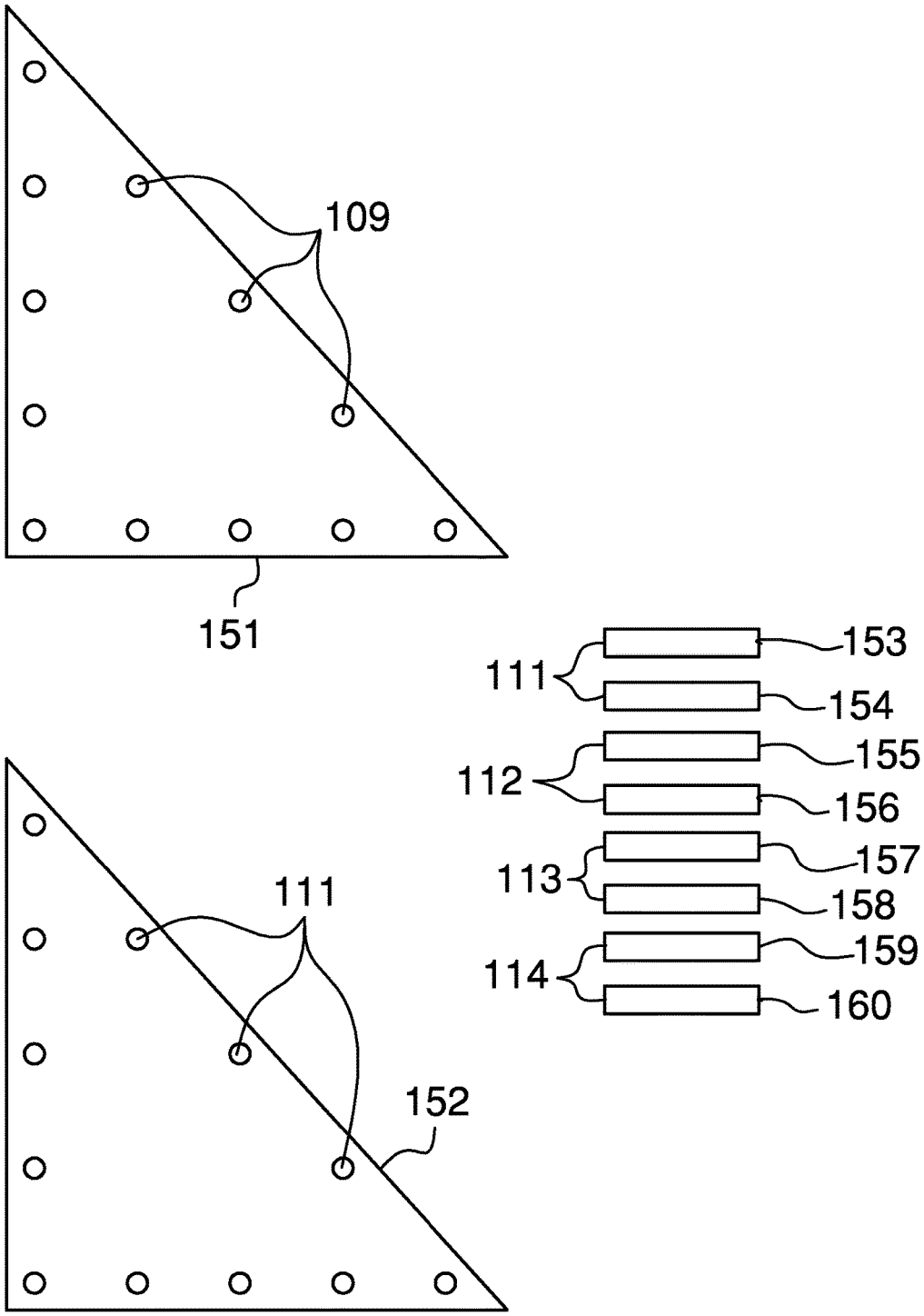
FIG. 7 is a detail view of an alternate embodiment of the disclosure.

There are several ways to attach a corner weight selected from the plurality of corner weights 103 to the swatch 101. In the first potential embodiment of the disclosure, as shown in FIG. 7, an eleventh plurality of holes 109 are formed through the surfaces of the eleventh mass 151 and a twelfth plurality of holes 110 are formed through the surfaces of the twelfth mass 152. The eleventh mass 151 is positioned so that the right angle corner of the eleventh mass 151 is positioned over a selected corner of the twenty first side 161 of the swatch 101. The twelfth mass 152 is positioned over the same selected corner of twenty second side 162 of the swatch 101 so that the twelfth plurality of holes 110 are aligned with the eleventh plurality of holes 109. The twelfth mass 152 can then joined to the swatch 101 and the eleventh mass 151 by sewing. In the second potential embodiment of the disclosure, the eleventh mass 151 and the twelfth mass 152 are formed using magnetized metals. In this embodiment, the eleventh mass 151 is positioned so that the right angle corner of the eleventh mass 151 is positioned over a selected corner of the twenty first side 161 of the swatch 101 and the twelfth mass 152 is positioned over the same selected corner of twenty second side 162 of the swatch 101 so that the eleventh mass 151 and the twelfth mass 152 are aligned. The magnetic attraction between the eleventh mass 151 and the twelfth mass 152 will secure the center weight 102 to the swatch 101. In a third potential embodiment of the disclosure, the eleventh mass 151 and the twelfth mass 152 can be attached using a snap device. In this embodiment, the eleventh mass 151 is formed with a plurality of snap posts 107 and the twelfth mass 152 is formed with a plurality of snap holes 108. As shown in FIG. 3, the swatch 101 can be fitted with grommets aligned to allow the each of the plurality of snap posts 107 to access each of the plurality of snap holes 108. Alternatively, the swatch 101 can be secured simply by using each of the plurality of snap posts 107 to push fabric from the swatch 101 into the plurality of snap holes 108.

The plurality of corner weights 103 further comprises a first corner weight 111, a second corner weight 112, a third corner weight 113, and a fourth corner weight 114. The first corner weight 111 further comprises a thirteenth mass 153 and a fourteenth mass 154. The thirteenth mass 153 corresponds to the eleventh mass 151. The fourteenth mass 154 corresponds to the twelfth mass 152. The second corner weight 112 further comprises a fifteenth mass 155 and a sixteenth mass 156. The fifteenth mass 155 corresponds to the eleventh mass 151. The sixteenth mass 156 corresponds to the twelfth mass 152. The third corner weight 113 further comprises a seventeenth mass 157 and an eighteenth mass 158. The seventeenth mass 157 corresponds to the eleventh mass 151. The eighteenth mass 158 corresponds to the twelfth mass 152. The fourth corner weight 114 further comprises a nineteenth mass 159 and a twentieth mass 160. The nineteenth mass 159 corresponds to the eleventh mass 151. The twentieth mass 160 corresponds to the twelfth mass 152.

The swatch 101 is a square piece of sheeting made from a textile. The purpose of the swatch 101 is to act like an air foil that, when the invention 100 is thrown and rotated, generates a lift that keep the invention 100 from falling to the ground 144. Ideally, the twenty first side 161 and the twenty second side 162 of the swatch 101 would have a smooth surface. Optionally, a decorative design 119 can be printed on the swatch 101. The performance of the swatch 101 can be improved by stiffening the swatch 101. The swatch 101 can be stiffened by treating the swatch 101 with a starch like substance including, but not limited to, polyvinylacetate or potato starch.

Optionally, the invention 100 can be further stiffened through the use of a fifth stiffener 115, a sixth stiffener 116, a seventh stiffener 117, and an eighth stiffener 118. The fifth stiffener 115, the sixth stiffener 116, the seventh stiffener 117, and the eighth stiffener 118 are each straight stiff bars.

There are two method to further stiffen the invention 100.

Figure 8:
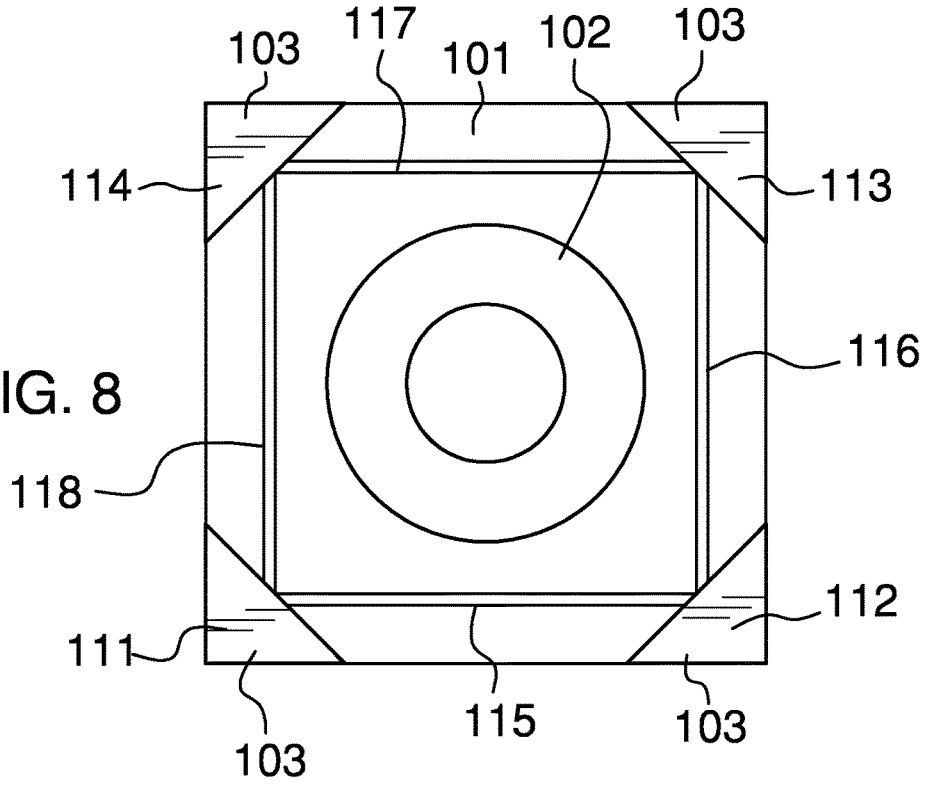
FIG. 8 is a detail view of an alternate embodiment of the disclosure.

The first method, as shown in FIG. 8, is to: 1) attach the first corner weight 111 to the second corner weight 112 using the fifth stiffener 115; 2) attach the second corner weight 112 to the third corner weight 113 using the sixth stiffener 116; 3) attach the third corner weight 113 to the fourth corner weight 114 using the seventh stiffener 117; and, 4) attach the fourth corner weight 114 to the first corner weight 111 using the eighth stiffener 118.

Figure 9:
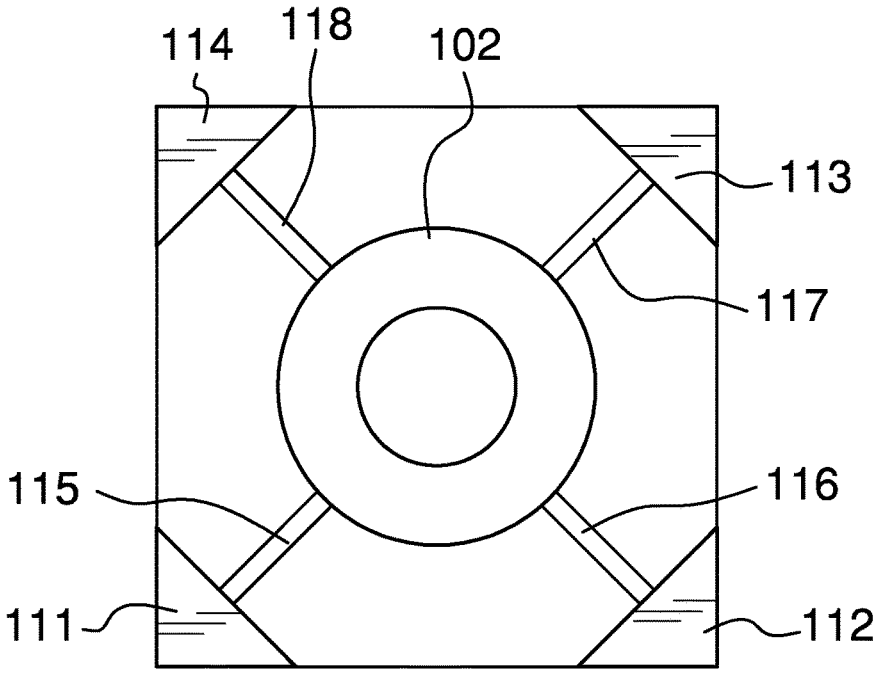
FIG. 9 is a detail view of an alternate embodiment of the disclosure.

The second method, as shown in FIG. 9, is to: 1) attach the first corner weight 111 to the center weight 102 using the fifth stiffener 115; 2) attach the second corner weight 112 to the center weight 102 using the sixth stiffener 116; 3) attach the third corner weight 113 to the center weight 102 using the seventh stiffener 117; and, 4) attach the fourth corner weight 114 to the center weight 102 using the eighth stiffener 118.

To use the invention 100, the center weight 102 and the plurality of corner weights 103 are placed on the swatch 101. The user 141 then holds on to the first corner weight 111 of the invention 100 and throws the invention 100 so that the twenty first side 161 of the swatch 101 is parallel to the ground 144. The user 141 throws the invention 100 with a flicking motion to give the invention 100 angular momentum as well as forward momentum. When magnets are used for the plurality of corner weights 103, multiple versions of the invention 100 can be stacked on top of each other to form a larger version of the invention 100.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; or, 3) the point, pivot, or axis around which something revolves.

Center of Rotation: As used in this disclosure, the center of rotation is the point of a rotating plane that does not move.

Centrifugal Action: As used in this disclosure, the term centrifugal action is used to describe the tendency of an object following a curved path to move away from the center of the curve through inertia.

Centripetal Force: As used in this disclosure, the term centripetal force is the force that prevents an object undergoing centrifugal action from moving away from the center of the curve, or alternatively that keeps the object moving along a circular path.

Inner Diameter: As used in this disclosure, the term inner diameter is used in the same way that a plumber would refer to the inner diameter of a pipe.

Outer Diameter: As used in this disclosure, the term outer diameter is used in the same way that a plumber would refer to the outer diameter of a pipe.

Sheeting: As used in this disclosure, sheeting is a material, such as cloth or plastic, in the form of a thin flexible layer or layers that is used to cover something.

Textile: As used in this disclosure, a textile is a material that is woven, knitted or felted. Synonyms in common usage for this definition of textile include fabric and cloth.

With respect to the above description, it is to be realized that the optimum dimensional relationship for the various components of the invention described above and in FIGS. 1 through 9, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A modular flying device comprising:

a swatch, a center weight, and a plurality of corner weights;

wherein the center weight and plurality of corner weights are attachable to the modular flying device;

wherein the center weight and plurality of corner weights are detachable from the modular flying device;

wherein the modular flying device is manually operated and powered;

wherein the swatch is a square piece of sheeting made from a textile;

wherein the center weight is attached to the swatch;

wherein the center weight is further defined with a first ring and a second ring;

wherein the swatch is designed with elasticity;

wherein when the modular flying device is rotating and the center of rotation is the center of the swatch then the span of the swatch will increase;

wherein the first ring and the second ring are positioned on a center ring so that a line drawn from the center of the first ring and the center of the second ring runs through the center of the swatch in a manner perpendicular to the swatch; the first ring is a circular metal disc with a circular open space; wherein the second ring is a circular metal disc with a circular open space; wherein the circular open space of the first ring is centered on the same center point as the first ring; wherein the circular open space of the second ring is centered on the same center point as the second ring; wherein the outer diameter of the first ring and the outer diameter of the second ring are identical; wherein the inner diameter of the first ring and the inner diameter of the second ring are identical; wherein each of the plurality of corner weights is attached to a corner of the swatch; each of the plurality of corner weights has a right isosceles triangle shape; wherein each of the plurality of corner weights is further defined with a first mass and a second mass; wherein the each of the plurality of corner weights is attached to the swatch; wherein the plurality of corner weights is further defined as a first corner weight, a second corner weight, a third corner weight, and a fourth corner weight; wherein the center weight is attached to the swatch magnetically; wherein each of the plurality of corner weights is attached to the swatch magnetically; wherein the center weight is attached to the swatch a first plurality of snaps and a second plurality of snap holes; wherein each of the plurality of corner weights is attached to the swatch using a third plurality of snaps and a fourth plurality of snap holes.

* * * * *